US009330868B2

(12) United States Patent
Gentsch et al.

(10) Patent No.: US 9,330,868 B2
(45) Date of Patent: May 3, 2016

(54) CONTACT ASSEMBLY FOR A VACUUM CIRCUIT BREAKER

(71) Applicant: ABB TECHNOLOGY AG, Zürich (CH)

(72) Inventors: Dietmar Gentsch, Ratingen (DE); Tarek Lamara, Confignon (CH)

(73) Assignee: ABB TECHNOLOGY AG, Zürich (CH)

( * ) Notice: Subject to any disclaimer, the term of this patent is extended or adjusted under 35 U.S.C. 154(b) by 0 days.

(21) Appl. No.: 14/162,443

(22) Filed: Jan. 23, 2014

(65) Prior Publication Data

US 2014/0131316 A1 May 15, 2014

Related U.S. Application Data

(63) Continuation of application No. PCT/EP2012/003045, filed on Jul. 19, 2012.

(30) Foreign Application Priority Data

Jul. 23, 2011 (EP) ..... 11006056

(51) Int. Cl.
*H01H 33/664* (2006.01)

(52) U.S. Cl.
CPC ..... *H01H 33/6641* (2013.01); *H01H 33/6642* (2013.01); *H01H 33/6644* (2013.01)

(58) Field of Classification Search
CPC ... H01H 33/14; H01H 33/187; H01H 33/664; H01H 33/6641–33/6646
USPC ..... 218/123, 127, 128, 129
See application file for complete search history.

(56) References Cited

U.S. PATENT DOCUMENTS 4,386,249 A * 5/1983 Gorman et al. ..... 218/126
4,445,015 A 4/1984 Zueckler
4,553,002 A * 11/1985 Slade ..... 218/128

(Continued)

FOREIGN PATENT DOCUMENTS

EP 0 082 801 A1 6/1983
EP 0 163 593 A1 12/1985
JP 5-190062 A 7/1993

OTHER PUBLICATIONS

Machine translation of JP1993-190062 (orig. doc. published Jul. 30, 1993).*

(Continued)

*Primary Examiner* — Renee Luebke
*Assistant Examiner* — William Bolton
(74) *Attorney, Agent, or Firm* — Buchanan Ingersoll & Rooney PC

(57) ABSTRACT

A contact assembly and a vacuum circuit breaker for interrupting an electrical current are disclosed. The contact assembly includes an outer field generating element for generating a first axial magnetic field (AMF), and an inner field generating element for generating a second AMF opposite to the first AMF. The inner field generating element can be coaxial with the outer field generating element and can have a smaller diameter than the outer field generating element. The outer field generating element can be cup-shaped and slotted with non-radial slots to generate the first AMF. The contact assembly can include an innermost conducting element for nominal current conduction and coaxially adjusted with the inner field generating element.

22 Claims, 5 Drawing Sheets

(56) References Cited

U.S. PATENT DOCUMENTS

| | | | | | |
|---|---|---|---|---|---|
| 4,667,070 | A | | 5/1987 | Zückler | |
| 4,704,506 | A | * | 11/1987 | Kurosawa et al. | 218/128 |
| 5,120,918 | A | * | 6/1992 | Thomas et al. | 218/130 |
| 5,804,788 | A | * | 9/1998 | Smith | 218/129 |
| 6,674,039 | B1 | * | 1/2004 | Banghard et al. | 218/123 |
| 2002/0043514 | A1 | | 4/2002 | Kim, Il | |
| 2010/0230388 | A1 | | 9/2010 | Tak et al. | |

OTHER PUBLICATIONS

International Search Report (PCT/ISA/210) mailed on Oct. 15, 2012, by the European Patent Office as the International Searching Authority for International Application No. PCT/EP2012/003045.

Written Opinion (PCT/ISA/237) mailed on Oct. 15, 2012, by the European Patent Office as the International Searching Authority for International Application No. PCT/EP2012/003045.

European Search Report for EP 11006056.3 dated Dec. 15, 2011.

* cited by examiner

CONTACT ASSEMBLY FOR A VACUUM CIRCUIT BREAKER

RELATED APPLICATION(S)

This application claims priority as a continuation application under 35 U.S.C. §120 to PCT/EP2012/003045, which was filed as an International Application on Jul. 19, 2012 designating the U.S., and which claims priority to European Application 11006056.3 filed in Europe on Jul. 23, 2011. The entire contents of these applications are hereby incorporated by reference in their entireties.

FIELD

The disclosure relates to the field of medium and high voltage equipment. For example, the disclosure relates to a contact assembly and a vacuum circuit breaker.

BACKGROUND INFORMATION

Vacuum circuit breakers can be used at medium voltage level for high current interruption at occasional short circuit current fault and for load current switching (interruption and contacting). A vacuum circuit breaker can include a vacuum chamber in which two contacts (or electrodes) are located that are moved towards each other or away from each other for closing or opening an electrical path in the circuit breaker. When moving the contacts away from each other, a burning arc can arise that has to be extinguished for interrupting the current. For high current interruption, however, vacuum circuit breakers for interrupting currents higher than 50 kA can be a challenge.

In order to achieve high current interruption performances, the erosion of the circuit breaker contacts can be limited, which results from a local overheating from the concentrated burning arc. Hence, the heat arising from the vacuum arc can be managed by spreading out the energy over the whole surface of the contacts. Up to now, at least two methods were used to control the vacuum arc in a way to distribute the heat flow over the contacts area.

The arc control in a vacuum interrupter can be achieved by generating either a transverse magnetic field (TMF) to drive the constricted arc in rotating motion under the effect of Lorentz forces, or an axial magnetic field (AMF) to confine the charged particles around the magnetic flux lines and to stabilize the arc by making it diffuse over the whole contact surface with low current density. An axial direction may be a direction substantially parallel to the movement of the contacts or substantially orthogonal to the facing contact surfaces of the field generating elements. A transversal direction may be a direction substantially orthogonal to the axial direction.

In most designs of AMF based vacuum interrupters, the AMF strength and distribution can be concentrated at the center of interrupter contacts leading to high erosion and interruption failure, for example, at high current. Accordingly, there may be a use for a contact design to prevent the concentration of the AMF in the center of electrodes at high current level.

One solution can be to introduce ferromagnetic element into the contacts assembly, for example, placed at the periphery of the contacts, which can shift the AMF maximum towards the contacts edges.

Another solution can be to introduce further components into the contact assembly which can generate a further AMF in the center of the contacts, which can lower the AMF maximum in the center of the contacts.

For example, US Patent Publication No. 2010/0230388A1 relates to an electrode for a vacuum interrupter. The electrode includes a contact electrode plate, an inner coil electrode and an outer coil electrode. The coil electrodes are formed of an electric conductor having an open loop shape and supporting pins.

However, these solutions may result in contacts with a high resistance that can induce high current losses an excessive thermal heating with the nominal current, and with complicated configurations that may render the manufacturing process slow and difficult and may induce high manufacturing costs.

SUMMARY

A contact assembly for interrupting an electrical current is disclosed, the contact assembly comprising: an outer field generating element configured to generate a first axial magnetic field (AMF); and an inner field generating element configured to generate a second axial magnetic field (AMF) opposite to the first axial magnetic field (AMF); wherein the inner field generating element is coaxial with the outer field generating element and has a smaller diameter than the outer field generating element; and wherein the outer field generating element is cup-shaped and slotted with non-radial slots configured to generate the first axial magnetic field (AMF).

A vacuum circuit breaker is disclosed, comprising: at least one contact electrode; and a contact assembly, the contact assembly including: an outer field generating element configured to generate a first axial magnetic field (AMF); and an inner field generating element configured to generate a second axial magnetic field (AMF) opposite to the first axial magnetic field (AMF); wherein the inner field generating element is coaxial with the outer field generating element and has a smaller diameter than the outer field generating element; and wherein the outer field generating element is cup-shaped and slotted with non-radial slots configured to generate the first axial magnetic field (AMF).

BRIEF DESCRIPTION OF THE DRAWINGS

In the following the disclosure will be described in greater detail by reference to exemplary embodiments and with reference to the attached drawings, in which FIG. 1 schematically shows a circuit breaker according to an exemplary embodiment of the disclosure.

The reference symbols used in the drawings, and their meanings, are listed in summary form in the list of reference symbols. In principle, identical parts are provided with the same reference symbols in the figures.

DETAILED DESCRIPTION

Figure 10:
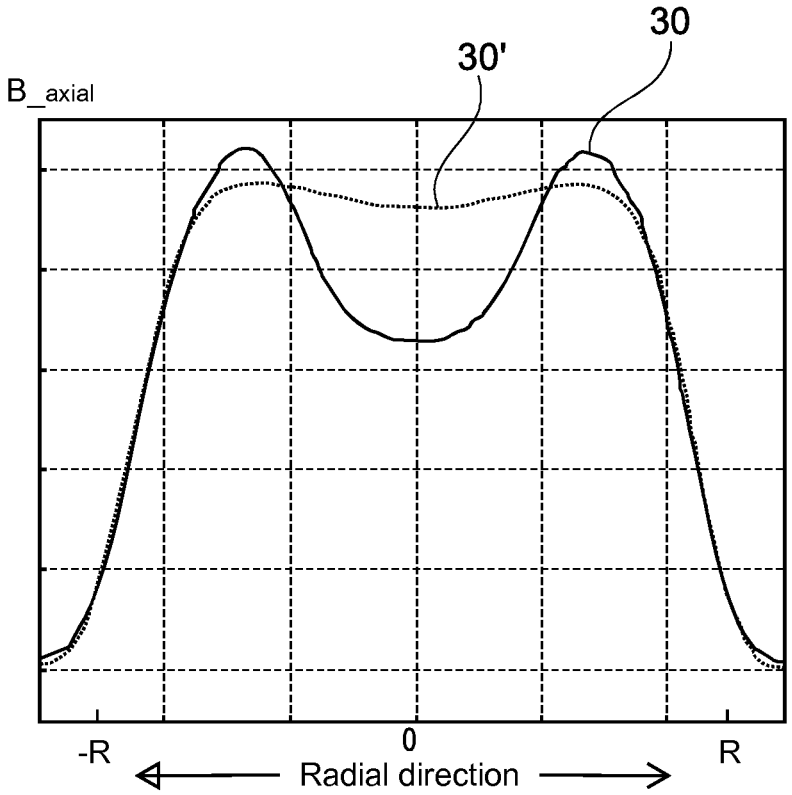
FIG. 10 shows a diagram with magnetic flux densities of the contact assemblies of FIGS. 8 and 9.

In accordance with an exemplary embodiment, a contact assembly for a vacuum circuit breaker that has relatively high current interruption performance and a relatively low resistance is disclosed, which can be simply manufactured and can have a low manufacturing costs.

In accordance with an exemplary embodiment, the disclosure relates to a contact assembly for interrupting an electrical current. The contact assembly may be used with electrical current devices, for example, in a vacuum circuit breaker assembly.

In accordance with an exemplary embodiment of the disclosure, the contact assembly can include an outer field generating element for generating a first AMF (axial magnetic field) and an inner field generating element for generating a second AMF opposite to the first AMF. The field generating elements can be chosen to reshape and enhance the total AMF generated by both field generating elements. The field generating elements may generate magnetic fields in opposite directions to reduce the magnetic flux density at the center of the contact assembly and to increase the magnetic field on the outer parts of the contact assembly. In accordance with an exemplary embodiment, the AMF can be shaped that the maximum of the AMF can be pushed towards the outer contact periphery. This AMF distribution may increase the area where the AMF is maximal, which may ensure a larger and more homogenous arc distribution over the contact surface of the contact assembly and may reduce the erosion of the contact material.

The outer field generating element may be cup-shaped and slotted with non-radial slots to generate the first AMF. A cup-shaped element may include a substantially flat base plate attached to a substantially cylindrical side wall. The outer field generating element can include plates forming the base plate and the side wall.

In accordance with an exemplary embodiment of the disclosure, the inner field generating element may be coaxial with the outer field generating element and may have a smaller diameter than the outer field generating element.

In accordance with an exemplary embodiment, an AMF arc control may be obtained by re-adjusting the radial distribution of the AMF, but without introducing any or at least a large amount of ferromagnetic material into the contact assembly. Although, introducing ferromagnetic material into the contact element may significantly increase the magnetic field and in a certain way may alter the AMF distribution, the introduction of ferromagnetic material may increase also significantly the nominal current losses. With the field generating elements, a similar effect for the arc control may be achieved by shaping the AMF profile but without introducing an iron core into the contact assembly. According to an exemplary embodiment of the disclosure, the inner field generating element can be at least partially surrounded by the cup-shaped outer field generating element, which may reduce the longitudinal dimension of the contact assembly.

According to an exemplary embodiment of the disclosure, the inner field generating element can be a coil oriented to generate the second AMF. A coil may be an electrical conduction component of the contact assembly that can have the form of a loop at least partially surrounding the longitudinal axis of the contact assembly. For example, a coil may be a cylindrical-shaped element or formed from a longitudinal body, whereas a cup-shaped element may be formed from a plate-like body.

According to an exemplary embodiment of the disclosure, the inner field generating element can be a hollow cylindrical or cup-shaped, and slotted with non-radial slots to generate the second AMF. The inner field generating element may contribute to the mechanical stiffness of the contact element. The cup-shaped inner field generating element may be opened towards a closing direction of the contact assembly. The cup-shaped inner field generating element can be opened in the opposite direction to take the form of a hollow cylinder.

According to an exemplary embodiment of the disclosure, the inner and/or outer field generating element can be made from stainless steel or other conductive hard material, which may meet the robustness and cost effectiveness criteria of the contact assembly.

According to an exemplary embodiment, the inner and/or outer field generating element can be made from a double or multiple layers in which one layer at least is made from a stainless steel or other conductive hard material, and at least a second layer made from a material with high thermal conductivity (for example: copper, copper alloys, silver . . . ), which can meet the robustness and cost effectiveness criteria of the contact assembly and may ensure a better thermal management during and after arcing (fast contacts cooling).

According to an exemplary embodiment of the disclosure, the contact assembly can include at least one cover element for contacting a further contact assembly. The outer field generating element and/or the inner field generating element may be covered by the at least one cover element. The cover element may provide a contact surface for contacting a further contact surface of the further contact assembly. The cover element may be formed of a material providing a high arc erosion resistance and high thermal conductivity.

According to an exemplary embodiment of the disclosure, the at least one cover element can be plate-like and slotted, which may increase the AMF and/or may reduce eddy current effects.

According to an exemplary embodiment of the disclosure, the outer field generating element can be covered by an outer contact element having substantially the same radial extension as the outer field generating element and the inner field generating element can be covered by an inner cover element having substantially the same radial extension as the inner field generating element. Each of the outer and inner field generating elements can be covered by a respective cover element.

In accordance with an exemplary embodiment, the contact assembly may include an inner contact element including the inner field generating element and the inner cover element and an outer contact element including the outer field generating element and the outer cover element. The inner contact element may serve as a nominal current path and may provide an opposite AMF to the one generated by the outer contact element for a better AMF distribution. The inner field generating element may be made from a material or a combination of materials with high electrical conductivity.

The inner contact element may have a small diameter to reduce the contact impedance and hence, the nominal current losses. However, the contact diameter of the inner contact element should not be too small, otherwise, the generation of the "opposite AMF" can be compromised. Although the inner contact element impedance can be distinctly smaller than the impedance of an AMF contact with an equivalent diameter, it is still non negligible and may be critical for some applications involving high nominal current conduction (for example, in a railway application).

According to an exemplary embodiment of the disclosure, the cover element can cover the outer and the inner field generating element and can have substantially the same radial extension as the outer field generating element. In accordance with an exemplary embodiment, both field generating elements can be covered by one cover element. The outer field generating element and the inner field generating element may be connected to the same plate for a saddle shape AMF generation. This configuration may reduce the number of elements and can guarantee a relatively high mechanical stability of the contacts assembly.

In an exemplary embodiment, the diameter of the inner contact element and the thickness and the material of the inner and the outer filed generating elements may be adjusted to optimize the current sharing between them during arcing, thus to optimize the saddle shape AMF generation.

According to an exemplary embodiment of the disclosure, the contact assembly can include a support element coaxial with the inner field generating element, wherein the support element can adapted for supporting a center of the cover element. The contact element may be the inner contact element or the cover element covering the inner and outer field generating element. The support element may include an electrical non-conductive material. In accordance with an exemplary embodiment, the mechanical stability of the contact assembly may be enhanced by adding a central support element (to resist to the mechanical stress while closing).

According to an exemplary embodiment of the disclosure, the (inner/outer) cover element can be plate-like and slotted. For example, the outer cover element may have first non-radial slots for enhancing the AMF of the outer field generating element. The outer cover element may have a central opening for accommodating the inner cover element. The inner cover element may have second non-radial slots for enhancing the AMF of the inner field generating element.

According to an exemplary embodiment of the disclosure, the contact assembly can include a pin contact element that may be coaxial with the inner (or the outer) field generating element. The pin contact element may have a smaller diameter as the inner (or the outer) field generating element. For example, the cover element may have a central hole for accommodating a central pin contact for the nominal current path.

For example, the pin contact element may be accommodated in the inner field generating element and the inner field generating element may be accommodated in the outer field generating element. In accordance with an exemplary embodiment, the contact assembly may be a multiple-contact system (with three or more co-axial contact elements). For example, the most inner part may be a pin contact designed for nominal current conduction with minimum losses and providing a high mechanical stability for contact closing. The intermediate or next inner part and the outer part may be AMF contact elements (for example each having a field generating element and a cover element) as described as above.

According to an exemplary embodiment of the disclosure, the pin contact element can protrude through a cover element covering the inner and/or outer field generating element. In accordance with an exemplary embodiment, the pin contact element may provide a nominal current path for the contact assembly.

According to an exemplary embodiment of the disclosure, the pin contact element can be at least partially surrounded by a cup-shaped inner field generating element. In accordance with an exemplary embodiment, the longitudinal extension of the contact assembly may be reduced.

In accordance with an exemplary embodiment, the disclosure relates to a vacuum circuit breaker with at least one contact electrode including a contact assembly as disclosed above and in the following. The vacuum circuit breaker may be adapted to switch currents of medium and high voltage. The vacuum circuit breaker may include a contact assembly with a multiple-contact system based only on AMF arc control, in which each electrode can be constituted of two or three co-axial contacts as described in the above and in the following.

Figure 1:
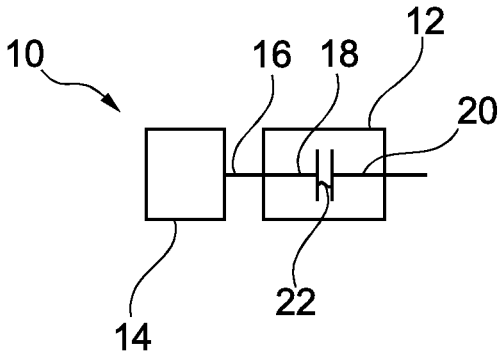

FIG. 1 schematically shows a circuit breaker 10 with a vacuum switching chamber 12 and drive 14 that can be adapted to move a first movable electrical contact 18 with respect to a second fixed electrical contact 20. The movable electrical contact 18 can be mechanically connected over a pushrod 16 with the mechanical drive 14. For closing the electrical path between the two contacts 18, 20, the movable contact 18 can be pushed onto the fixed contact 20. For disconnecting the electrical path formed by the two contacts 18, 20, the movable contact 18 can be retracted from the fixed contact 20. During the retracting of the movable contact, an arc 22 can be generated which has to be distinguished for interrupting the electrical connection.

The electrical contact 18 and/or the electrical contact 20 can include a contact assembly as described in the above and in the following.

Figure 2:
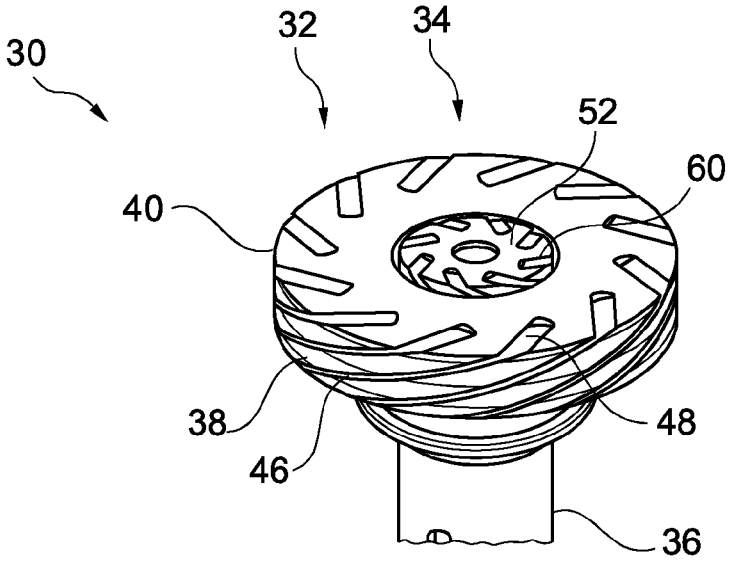
FIG. 2 schematically shows a three-dimensional view of a contact assembly according to an exemplary embodiment of the disclosure.
Figure 3:
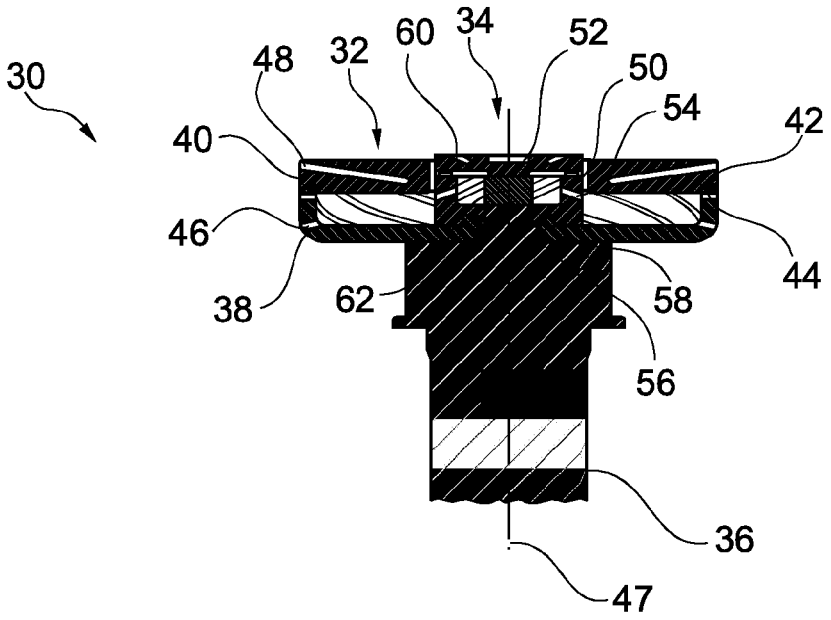
FIG. 3 shows a schematically shows an exemplary cross-sectional view of the contact assembly of FIG. 2.

FIG. 2 schematically shows a three-dimensional view of a contact assembly 30, which is shown in FIG. 3 in a schematically cross-sectional view. The contact assembly 30 can include an outer contact element 32 and an inner contact element 34 that can be coaxial with respect to the outer contact element 32.

The outer contact element 32 can include an outer field generating element 38 that can be cup-shaped and an outer cover element 40 that has an opening 42 for receiving a rim 44 on a side wall of the cup-shaped element 38.

A base plate of the cup-shaped element 38 can abut onto the end of a rod 36 and can have an opening that can be aligned onto a central plug of the rod 36. The outer contact element 32 can surround the inner contact element 34. In accordance with an exemplary embodiment, both elements 32 and 34 can be designed for vacuum arc interruption. The field generating element 32 may have a geometry such as an AMF cup-shaped contact or another form among AMF coils.

The outer field generating element 38 can be designed as a thin cup-slotted piece in such a way to create an AMF field. For example, the field generating element 38 can include slots 46 that are non-radial to a longitudinal and central axis 47 of the contact assembly 30.

The outer field generating element 38 can be made from a kind of stainless steel (or any other conductive hard material) to meet the robustness and cost effectiveness criteria. The thickness of the outer field generating element 38 piece should be small in order to provide a large effective AMF zone between the electrical contacts 18, 20 of the circuit breaker 10 and hence a larger electrode area for the diffuse arc.

The outer field generating element 38 may also be a combination of two or multiple layers for which at least one layer can be made from a hard conductive material (for example, Stainless steel) and at least a second layer made from an electrically conductive material with high thermal conductivity (for example, Cu, Ag, . . . ). The first layer can be responsible for the mechanical stability of the contact and the second one can be responsible for the current conduction and also thermal management during and after arcing.

In accordance with an exemplary embodiment, the outer field generating element 38 may be also a single or multiple-segments coil made from a hard conductive material to meet also the robustness and cost effectiveness criteria. For example, the outer field generating element 38 can be also made from a combination of conductive materials with at least one hard conductive material (for example, Stainless steel) and at least a second one from the family of electrically conductive materials with high thermal conductivity (for example, Cu, Ag, . . . ), which can improve also the thermal management of the outer contacts during and after arcing.

The outer cover element 40 of the outer contact element 32 can be formed as an upper plate and may be made of the same material as the lower part 38 or another erosion resisting material with high electrical conductivity (for example, CuCr). The outer cover element 40 can be designed as a hollow disc with large area and constitutes the contact surface of the outer contact element 32, which can be in touch with the plasma arc 22. The outer cover element 40 can also be slotted with slots 48 to increase the AMF and to reduce eddy current effects. The slots 46 of the outer cover element 40 can be non-radial in the same direction as the slots 46 of the field generating element 38. Further, the slots 46 can be aligned with the slots 48 such that the slots 48 are extensions of the slots 46.

The inner contact element 34 can include an inner field generating element 50 that can be cup-shaped and an inner cover element 52 that can have the same radius as the inner contact element 34.

The cover element 52 can be formed like a plate and can be in contact with the arc 22. The cover element 52 can have a certain width (radius) to collect enough current during the arcing phase.

The inner field generating element 50 can be placed behind the inner cover element 32, and may take the form of a hollow cylinder or a down cup holding the inner cover element 52. In FIG. 3, the inner field generating element 50 can be a cup-shaped with an opening facing into the closing direction of the contact assembly 30.

The inner field generating element 50 may be a single or multiple segments coil oriented to generate an opposite AMF with respect to the AMF of the outer contact element 32, or, as shown in FIGS. 2 and 3, a cup-shape slotted element 50, where the cup can be slotted with slots 54 in the opposite radial direction of the slots 46, 48 of the outer contact element 32.

The cup-shaped element 50 can have an opening 56 for receiving a rim 58 on the base plate of the outer cup-shaped element 38.

In accordance with an exemplary embodiment, for the nominal current path, the cup diameter of the cup-shaped element 50 should be small to reduce the contact impedance. However, the cup or coil diameter of the cup-shaped element 50 should not be too small. Otherwise, for example, it may not generate a sufficient magnetic field with certain strength. The cup or the coil thickness of the field generating element 50 should be large (larger than the outer field generating element coil thickness) to reduce the bulk resistance.

The inner cover element 52 can also be slotted with slots 60 to increase the AMF of the inner field generating element 50 and to reduce eddy current effects. The slots 60 of the inner cover element 52 can be non-radial in the same direction as the slots 54 of the inner field generating element 50. The slots 54, 60 in the inner contact element 34 can have an opposite radial direction to that of the slots 46, 48 of the outer contact element 32.

The field generating element 50 and the cover element 52 may be made from a strong material to resist to mechanical stress while closing. Both elements 50, 52 may be made from an electrically high conductive material to reduce the losses of the nominal current.

The contact assembly 10 may include a support element 62 that can be situated inside the cup-shaped element 50 and can abut on one side to a protrusion of the rod 36 and on the other side on the cover element 52. With the support element 62, additional support like a cylinder 62 may be added at the center of the contact assembly 30 to avoid the deformation of the inner cover element 52 while closing. The support element 62 may be made of a hard material with poor electrical conductivity since it can be introduced only for mechanical stability purpose. For example, the support element 62 may be made of a full cylinder of ceramic coated or surrounded by a very thin hollow stainless steel cylinder, to increase the resistance and maintain the mechanical stability.

Figure 4:
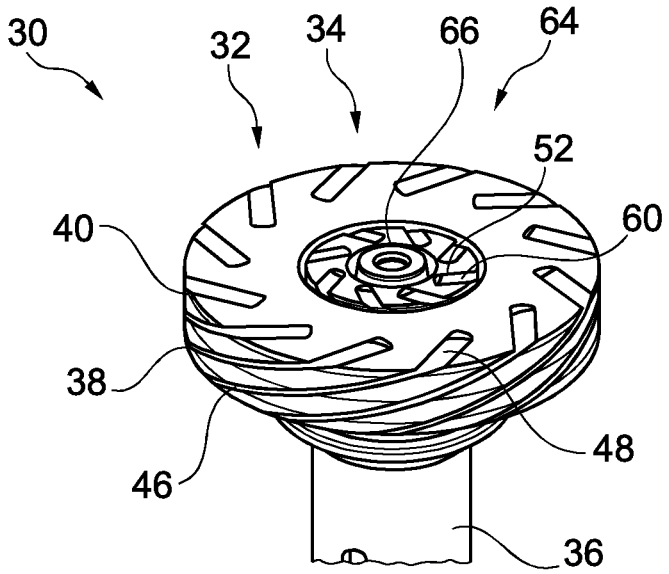
FIG. 4 schematically shows a three-dimensional view of a contact assembly according to an exemplary embodiment of the disclosure.
Figure 5:
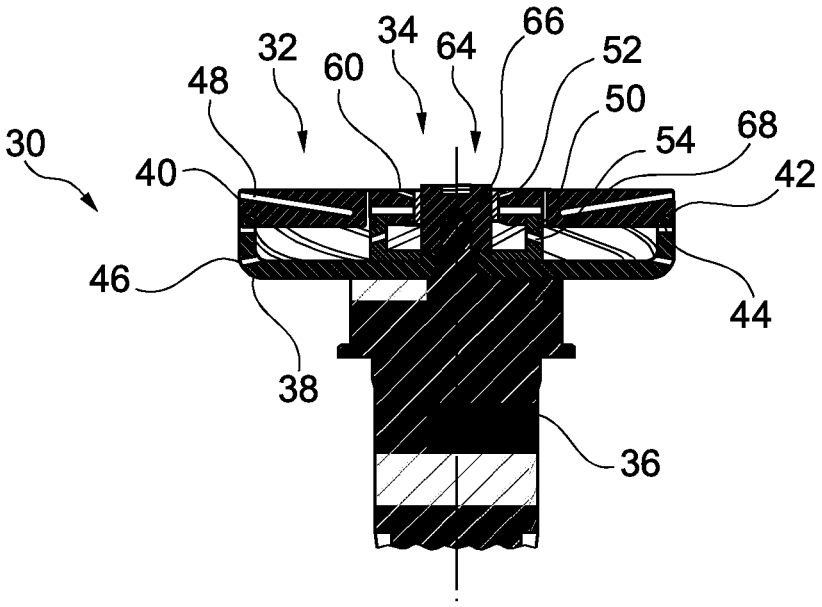
FIG. 5 shows a schematically shows an exemplary cross-sectional view of the contact assembly of FIG. 4.

FIGS. 4 and 5 show a triple contact version of a contact assembly 30 in accordance with an exemplary embodiment. An outer contact element 32 of the contact assembly 30 of FIGS. 4 and 5 can be similar to the double contact one shown in FIGS. 2 and 3 with a cup-shape slotted element 38 to generate an AMF and a hollow disk 40 to be in contact with the arc 22, which can also be slotted to increase the AMF and to reduce eddy current effects.

An intermediate contact element 34 can be slightly different from the contact element 34 shown in FIGS. 2 and 3. The intention of the intermediate contact element 34 can be to create an opposite AMF to the one generated by the outer contact element 32. Contrary to FIGS. 2 and 3, the contact element 34 may not be considered for the nominal current path.

The intermediate contact element includes an inner field generating element 50 and a cover element 52.

The field generating element 50 can be designed in such a way to create an AMF opposite to the AMF of the outer contact element 32. The field generating element 50 may be made from a kind of stainless steel (or any other conductive hard material) to meet the robustness and cost effectiveness criteria. In accordance with an exemplary embodiment, the field generating element 50 can be made from a combination of conductive materials with at least one hard conductive material (for example, Stainless steel) and at least a second material with high thermal conductivity (for example, Cu, Ag . . . ). These materials may meet the robustness and cost effectiveness criteria of the contact assembly and may ensure a better thermal management during and after arcing (fast contacts cooling).

The thickness of field generating element 50 should be small since it is not concerned by the nominal current conduction and also in order to provide a large AMF zone. The field generating element 50 may be a single coil or multiple coils oriented to generate an AMF opposite to the AMF of the outer contact element 32. In accordance with an exemplary embodiment, as shown in FIG. 5, the field generating element 50 may be a cup-shape slotted element, where the cup has slots 54 in the opposite direction of the slots 46, 48 of the outer contact element 32.

For centering the inner field generating element 52 with respect to the contact assembly 30, the cup-shaped element 52 can have an opening that can be received by an inner rim of the outer cup-shaped field generating element 38

The cover element 52 of the intermediate contact element 34 may be made of the same material as the field generating element 50 or another erosion resisting conductive material with high thermal conductivity. The cover element 52 may be also designed as a small hollow disc 52, which can be in touch with the plasma arc 22. The cover element 52 may have also slots 60 to increase the opposite AMF strength and to reduce eddy current effects.

The inner contact element 64 of the multiple contacts can be designed as a pin contact element 66 for the nominal current path. The pin contact element may also be used at the initial vacuum arcing phase while performing the current interruption. The pin contact element 66 may be made of a material with high electrical conductivity (for example, Cu, CuCr, or other Cu alloys). The pin contact element 66 may have a central opening 68 that can be received by a protrusion of the rod 36 to center the pin contact element 66 with respect to the contact assembly 30.

Figure 6:
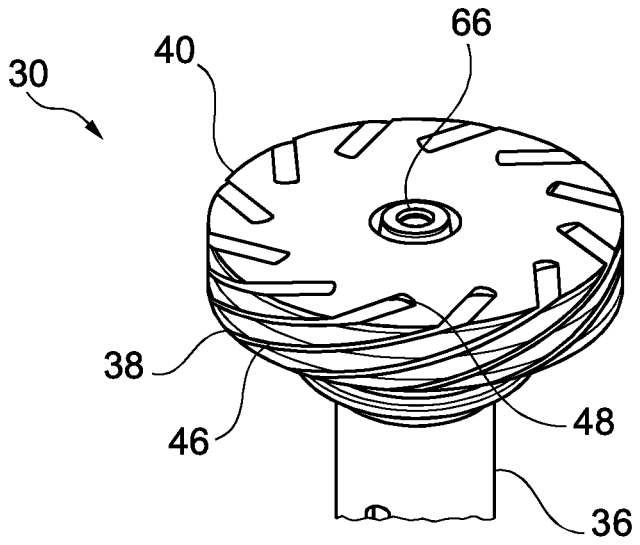
FIG. 6 schematically shows a three-dimensional view of a contact assembly according to an exemplary embodiment of the disclosure.
Figure 7:
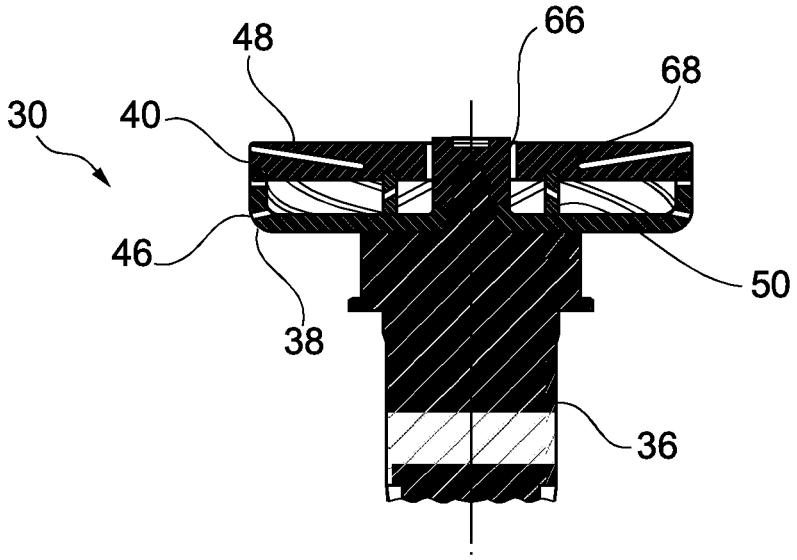
FIG. 7 shows a schematically shows an exemplary cross-sectional view of the contact assembly of FIG. 5.

FIGS. 6 and 7 show a contact assembly 30 with a cover element 40 covering the outer field generating element 38 and the inner field generating element 50. The outer field generating element 38 and the inner field generating element 50 can be connected to the same upper plate as cover element 40. The cover element 40 can be designed as a hollow disc with a larger surface than in the exemplary embodiments shown in FIGS. 2 to 5. The cover element 40 can be arranged over both field generating elements 38, 50.

The outer field generating element 38 can be designed in the same way as described in the exemplary embodiment shown in FIGS. 2-5 in such a way to create an AMF field.

The inner field generating element 50 can be designed in such a way to create an opposite AMF. The inner field generating element 50 may be made from a kind of stainless steel (or any other conductive hard material) to meet the robustness and cost effectiveness criteria. In accordance with an exemplary embodiment, the field generating element 50 can be made from a combination of conductive materials with at least one hard conductive material (for example, Stainless steel) and at least a second material with high thermal conductivity (for example, Cu, Ag, . . . ). These materials may meet the robustness and cost effectiveness criteria of the contact assembly and may ensure a better thermal management during and after arcing.

The thickness of the inner field generating element 50 should be small since it may not participate in the nominal current conduction and also in order to provide a large AMF zone. The inner field generating element 50 may be a single coil or multiple coils oriented in the opposite direction of the outer contacts coils to generate an opposite AMF. In accordance with an exemplary embodiment, the inner field generating element 50 may be cup-shape slotted contact, where the cup is slotted in the opposite direction of the outer ones 46. 48. As shown in FIG. 7, the inner field generating element 50 may be hollow cylinder shaped and may be centered with respect to the contact assembly by receiving its upper end in an opening 68 in the cover element 40.

The inner contact element 66 may be designed as a pin contact element 66 for nominal current path and also, may be used at the initial vacuum arcing phase while performing the current interruption. The pin contact element 66 can be made of a material with high electrical conductivity (for example, Cu, CuCr, or other Cu alloys) and can be slotted, for example, in a particular way to reduce eddy current effects.

During the arcing process, the current distribution between the inner field generating element 50 and the outer field generating element 38 may be adjusted by adequately choosing the individual resistances, for example, adjusting their thickness and their material resistivity. In accordance with an exemplary embodiment, this can naturally influence and adjust the distribution of the consequent AMF field. The AMF distribution (AMF radial profile) can be also altered (optimized) by adjusting the diameter of the inner field generating element 50.

In the following the operation of the vacuum circuit breaker 10 (see FIG. 1) with two contacts 18, 20 having a contact assembly 30 as described in the above and in the following is described. For example, the vacuum circuit breaker 10 may have two equivalent designed contact assembles 30.

In the embodiment shown in FIGS. 2 and 3, when the contact assemblies 30 are in closed position, the load current flows through the inner contact elements 34 (inner field generating element 50 and inner cover element 52 having low contact resistance).

For current interruption, the contact assemblies 30 can be moved away from each other and an initial arc 22 can be generated between the inner contact elements 34 and develops shortly in transition modes as in standard small diameter AMF contacts depending on the current level. At low current, the arc column 22 can expand in diffuse mode with increasing the gap distance and the instantaneous current as well.

At high current, the generated axial magnetic field by the inner contact element 34 can diffuse the arc 22 between the inner contact elements 34. The arc 22 can reach the inter-electrode gap (between the inner cover element 52 and outer contact element 40) after a short time (few ms), and then can split between the inner cover element 52 and outer contact element 40 and distributes homogeneously over both contact elements 34, 32 under the effect of AMF generated by both inner and outer field generating element 50, 38, and remains in diffuse mode until the arc extinction.

In the exemplary embodiments shown in FIGS. 4-7, when the contact assemblies 30 are in closed position, the load current can flow through the pin contact element 66 (having a very low contact resistance).

For current interruption, an initial arc 22 can be generated between the pin contact elements 66 and can develop shortly in transition modes depending on the current level. The arc 22 can undergo a natural expansion under its own inner pressure.

The arc 22 can crosses the inter-electrode gap (between the pin contact element and the cover element 52 or 40) and can reach the outer cover element 40 (or the intermediate cover element 52 and then the outer cover element 40) after a very short time (few ms) due to its small diameter. Then, the current starts to flow through the inner and outer field generating elements 50, 38 generating the desired AMF which is supposed to stabilize the arc 22. The arc 22 then commutes to a fully diffused arc mode with uniform distribution and remains in diffuse until the arc extinction.

Figure 8:
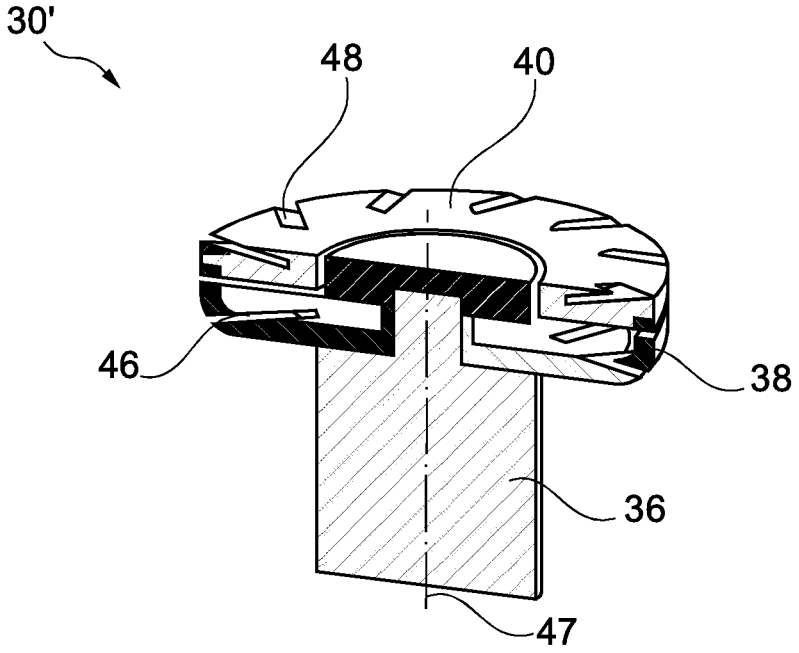
FIG. 8 shows an exemplary cross-sectional view of a contact assembly.
Figure 9:
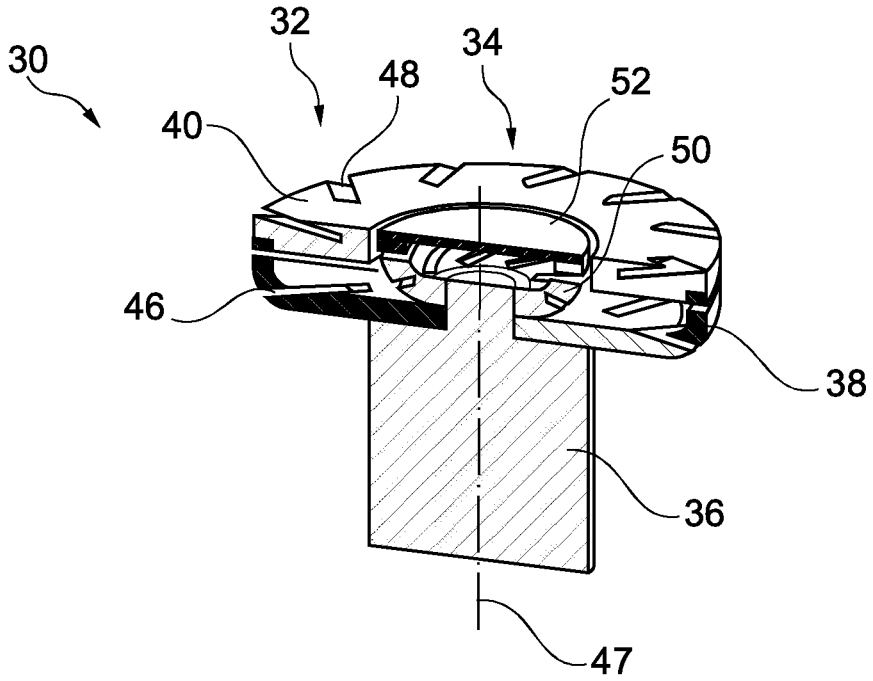
FIG. 9 shows a cross-sectional view of a contact assembly according to an exemplary embodiment of the disclosure.

In the following an AMF field simulation is described, which shows the above explained generation of the magnetic field. In FIGS. 8 and 9, a cross-sectional view of two exemplary geometries of two contact assemblies 30' used for simulation is shown. The contact assembly 30' shown in FIG. 8 does not have an inner field generating element and the contact assembly 30 has an inner field generating element 50.

The contact assembly 30 of FIG. 9 differs from the contact assembly shown in FIGS. 2 and 3 in that the inner plate-like cover element 52 is not slotted and that there is no support element for supporting the cover element 52.

In order to show the effect of the inner opposite AMF field generating element 50 on the magnetic field strength and also the AMF shape, the contact assemblies 30, 30' are compared. As disclosed herein, the first contact assembly 30' has a plain inner contact element (butt contacts) and the second has an opposite AMF contact element 34 (the simulation has been made without including the eddy current effect).

The result of the simulation is shown in FIG. 10. In the diagram, the vertical axis indicates the axial magnetic flux density ($B_{axial}$) and the horizontal axis indicates the radial distance from the axis 47; and R is the contact radius.

The simulation of the axial magnetic field (AMF) for both embodiments 30, 30' shows that the radial distribution of the axial magnetic field in the second embodiment 30 has a saddle shape which may be considered to be much better for a uniform arc distribution. The maximum AMF is situated close to the periphery of the outer contact element 32 and its strength is higher than in the first embodiment 30. In contrast, in the middle of the contacts the AMF strength is lowered by the opposite AMF component created by the inner AMF contact and thus, the AMF strength in the middle of the contact assembly 30 is lower than in the middle of the contact assembly 30'.

While the disclosure has been illustrated and described in detail in the drawings and foregoing description, such illustration and description are to be considered illustrative or exemplary and not restrictive; the disclosure is not limited to the disclosed embodiments. Other variations to the disclosed embodiments can be understood and effected by those skilled in the art and practicing the claimed disclosure, from a study of the drawings, the disclosure, and the appended claims. In the claims, the word "including" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 circuit breaker
12 vacuum switching chamber
14 drive
16 push rod
18 movable electrical contact
20 fixed electrical contact
22 arc
30 contact assembly
32 outer contact element
34 inner contact element, intermediate contact element
36 rod
38 outer field generating element
40 outer cover element
42 opening
44 rim
46 slots
48 slots
50 inner field generating element
52 inner cover element
54 slots
56 opening
58 rim
60 slots
62 support element
64 inner contact element
66 pin contact element
68 opening

What is claimed is:

1. A contact assembly for interrupting an electrical current, the contact assembly comprising:

an outer field generating element configured to generate a first axial magnetic field (AMF); and an inner field generating element configured to generate a second axial magnetic field (AMF) opposite to the first axial magnetic field (AMF);

wherein the inner field generating element is coaxial with the outer field generating element and has a smaller diameter than the outer field generating element, wherein the outer field generating element is cup-shaped and slotted with non-radial slots configured to generate the first axial magnetic field (AMF), wherein the contact assembly further comprises at least one cover element for contacting a further contact assembly, and an inner cover element having substantially a same radial extension as the inner field generating element, wherein at least one of the outer field generating element and the inner field generating element is covered by the at least one cover element, and wherein the inner field generating element is covered by the inner cover element.

2. The contact assembly of claim 1, wherein the inner field generating element is at least partially surrounded by the cup-shaped outer field generating element.

3. The contact assembly of claim 1, wherein the inner field generating element is a coil oriented to generate the second axial magnetic field (AMF).

4. The contact assembly of claim 1, wherein the inner field generating element is cup-shaped and slotted with non-radial slots configured to generate the second axial magnetic field (AMF).

5. The contact assembly of claim 1, wherein at least one of the outer field generating element and the inner field generating element is made from at least one first layer made from a conductive hard material and at least one second layer made from a conductive material with high thermal conductivity.

6. The contact assembly of claim 1, wherein the at least one cover element is plate-like and slotted.

7. The contact assembly of claim 1, comprising:

an outer cover element having substantially a same radial extension as the outer field generating element, and wherein the outer field generating element is covered by the outer cover element.

8. The contact assembly of claim 1, wherein the cover element covers the outer and the inner field generating element and has substantially a same radial extension as the outer field generating element.

9. The contact assembly of claim 1, comprising:

a support element coaxial with the inner field generating element.

10. The contact assembly of claim 9, wherein the support element is electrically highly resistive and adapted for supporting a center of the cover element.

11. The contact assembly of claim 1, comprising:

a pin contact element.

12. The contact assembly of claim 11, wherein the pin contact element is coaxial with the inner field generating element.

13. The contact assembly of claim 12, wherein the pin contact element has a smaller diameter than the inner field generating element.

14. The contact assembly of claim 11, wherein the pin contact element is at least partially surrounded by a cup-shaped inner field generating element.

15. The contact assembly of claim 11, wherein the pin contact element protrudes through the at least one cover element.

16. A contact assembly for interrupting an electrical current, the contact assembly comprising:

an outer field generating element configured to generate a first axial magnetic field (AMF); and an inner field generating element configured to generate a second axial magnetic field (AMF) opposite to the first axial magnetic field (AMF);

wherein the inner field generating element is coaxial with the outer field generating element and has a smaller diameter than the outer field generating element, wherein the outer field generating element is cup-shaped and slotted with non-radial slots configured to generate the first axial magnetic field (AMF), wherein the contact assembly further comprises a in contact element, and a cover element covering at least one of the inner field generating element and the outer field generating element, and wherein the pin contact element protrudes through the cover element.

17. A vacuum circuit breaker, comprising:

at least one contact electrode; and the contact assembly of claim 16.

18. The vacuum circuit breaker of claim 17, wherein the inner field generating element is at least partially surrounded by the cup-shaped outer field generating element.

19. The vacuum circuit breaker of claim 17, wherein the inner field generating element is a coil oriented to generate the second axial magnetic field (AMF).

20. A vacuum circuit breaker, comprising:

at least one contact electrode; and a contact assembly, the contact assembly including:

an outer field generating element configured to generate a first axial magnetic field (AMF); and an inner field generating element configured to generate a second axial magnetic field (AMF) opposite to the first axial magnetic field (AMF);

wherein the inner field generating element is coaxial with the outer field generating element and has a smaller diameter than the outer field generating element; and wherein the outer field generating element is cup-shaped and slotted with non-radial slots configured to generate the first axial magnetic field (AMF), wherein the contact assembly further includes at least one cover element for contacting a further contact assembly, and an inner cover element having substantially a same radial extension as the inner field generating element, wherein at least one of the outer field generating element and the inner field generating element is covered by the at least one cover element, and wherein the inner field generating element is covered by the inner cover element.

21. The vacuum circuit breaker of claim 20, wherein the inner field generating element is at least partially surrounded by the cup-shaped outer field generating element.

22. The vacuum circuit breaker of claim 20, wherein the inner field generating element is a coil oriented to generate the second axial magnetic field (AMF).

* * * * *